US005201374A

United States Patent [19]

Rahm

[11] Patent Number: 5,201,374

[45] Date of Patent: Apr. 13, 1993

[54] SCREW JOINT TIGHTENING POWER TOOL

[75] Inventor: Erik R. Rahm, Upplands Väsby, Sweden

[73] Assignee: Atlas Copco Tools AB, Stockholm, Sweden

[21] Appl. No.: 819,119

[22] Filed: Jan. 10, 1992

[30] Foreign Application Priority Data

Jan. 10, 1991 [SE] Sweden ..... 9100070

[51] Int. Cl.[5] ..... B25B 23/14

[52] U.S. Cl. ..... 173/178; 173/176; 192/56 R

[58] Field of Search ..... 173/178, 176; 192/150, 192/56 R, 0.034; 81/470, 474

[56] References Cited

U.S. PATENT DOCUMENTS

| | | | |
|---|---|---|---|
| 3,477,521 | 11/1969 | Kiester et al. | 173/176 |
| 3,752,277 | 8/1973 | Nakai | 173/178 |
| 4,307,784 | 12/1981 | Smith | 81/470 |
| 4,951,756 | 8/1990 | Everett et al. | 192/56 R |
| 5,054,588 | 10/1991 | Thorp et al. | 192/150 |

*Primary Examiner*—Frank T. Yost
*Assistant Examiner*—Allan M. Schrock
*Attorney, Agent, or Firm*—Frishauf, Holtz, Goodman & Woodward

[57] ABSTRACT

Screw joint tightening power tool, comprising a rotation motor (13), a power control (34), and a torque responsive override clutch (15) coupling the motor (13) to an output shaft (16). A power control (34) actuating mechanism is associated with the clutch (15) and comprises a push rod (36) which in an ON-position rests axially against a transversely movable latch (41) and is released for axial displacement toward an OFF-position at relative rotation between the driving and driven halves (20, 22) of the clutch (15). The actuating mechanism further comprises balls (45) which are disposed in peripheral pockets (48) in one of the clutch halves, either of which balls (45) is arranged to cooperate with the latch (41) to shift the latter to a push rod (36) releasing position to, thereby, make the power control (34) shut off the power supply to the motor (13) as the clutch (15) overrides at a desired torque level.

4 Claims, 2 Drawing Sheets

SCREW JOINT TIGHTENING POWER TOOL

BACKGROUND OF THE INVENTION

This invention relates to a screw joint tightening power tool of the type previously described in U.S. Pat. No. 4,951,756 and recited in the preamble of claim 1.

The power tool described in the above patent publication comprises a pneumatic vane motor supplied with pressure air via a supply valve. The latter is shifted from an ON-position to an OFF-position by a mechanism including an axial rod, a transverse latch member movably supported on the output shaft and an actuator cam supported on the driving clutch half. This actuator cam comprises a ring which is formed with a number of cam surfaces for interengagement with the latch member and which is freely rotatable over a limited angle relative to the driving clutch half so as to adjust automatically the interengagement point between the latch member and the cam surfaces to relative positions between the clutch halves where the maximum torque transferred by the clutch is just passed.

This control valve shifting mechanism has a serious drawback though, which has a negative influence on the accuracy of the maximum output torque level. This drawback is related to the ring shaped actuator cam which due to a relatively high inertia is too sluggish in action to provide a fast enough adjustment of the interengagement point between the cam surfaces and the latch member.

OBJECT OF THE INVENTION

The main object of the invention is to accomplish a power tool with a low inertia fast acting cam means for ensuring a correct self adjustment of the engagement point with the latch member, even at very fast processes.

SUMMARY OF THE INVENTION

According to the present invention, a screw joint tightening power tool, comprises a housing (10); a rotation motor (13) and power control means (34) connected to the motor (13); power transmitting means coupling the motor (13) to an output shaft (16) and including a rolling member type override clutch (15) with a driving half (20) and a driven half (22), the clutch hales (20, 22) being coupled by torque transferring cam means (26, 27) which have trapped therebetween rolling members (24) and the clutch halves (20, 22) being provided with dwell portions (28) for allowing a limited relative rotation of the clutch halves (20, 22) without transferring any torque therebetween; a control means shifting mechanism associated with the clutch (15) and including an axially extending and longitudinally displaceable rod (36) coupled to the power control means (34); a latch member (41) radially movable relative to the output shaft (16) for movement between a rest position in which the rod (36) is axially supported in a power control means (34) ON-position and an activated position in which the rod (36) is released for axial movement towards a power control means (34) OFF-position; and an actuating means (45) associated with the driving clutch half (20) and arranged to engage and shift radially the latch member (41) from the rest position to the activated position at relative rotation of the clutch halves (20, 22). The actuating means comprises a number of rolling elements (45) supported in pockets (48) in the driving clutch half (20), each of the pockets (48) having a peripheral extent so as to provide for peripheral movability of the corresponding rolling element (45), thereby enabling self adjustment in both rotation directions of a point of actuating interengagement between the rolling elements (45) and the latch member (41) to relative positions between the clutch halves (20, 22) where a maximum transferred torque of the clutch is passed.

A preferred embodiment of the invention is described below in detail with reference to the accompanying drawings.

DETAILED DESCRIPTION

Figure 1:
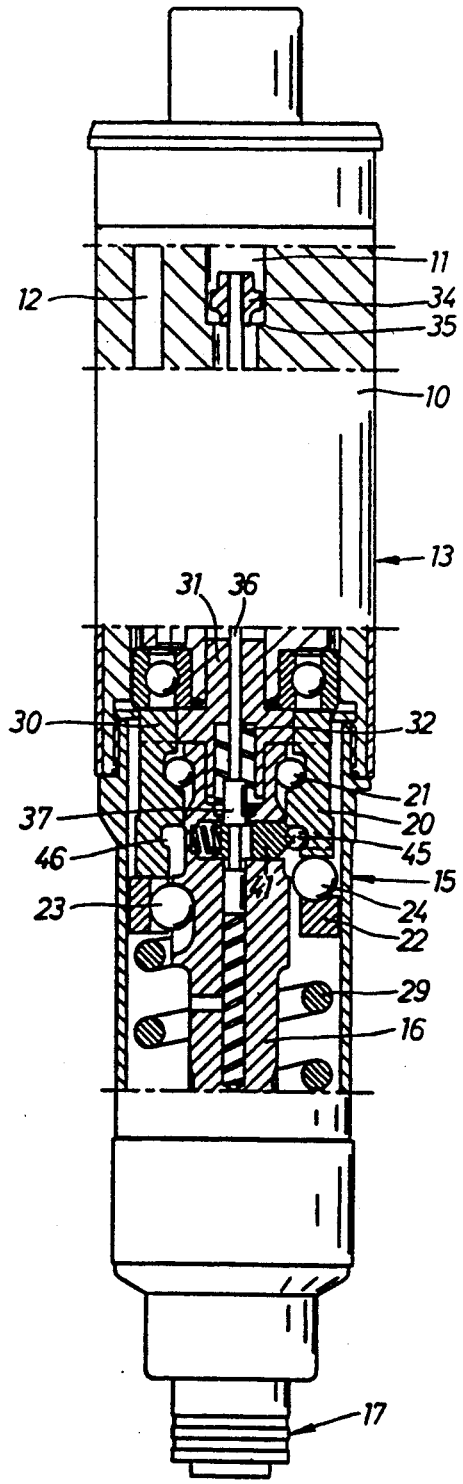
FIG. 1 shows, partly in section, a side view of a power screw driver according to the invention.

The power tool shown in the drawing figures is a pneumatic power screw driver of the straight type with a so called push start and a torque related automatic shut-off.

The screw driver comprises a housing 10 which at its rear end is formed with a pressure air inlet passage 11 and an exhaust passage 12. Both of these passages communicate with a rotary motor 13, preferably of the sliding vane type. (Not shown in detail). Via a power transmission including a torque responsive override clutch 15, the motor 13 is drivingly connected to an output shaft 16.

The latter is provided with a chuck 17 for attachment of screw driving bits.

The override clutch 15 comrises a driving clutch half 20, which is rotatively journalled relative to the output shaft 16 by means of a ball bearing 21, a driven clutch half 22, which is axially displaceable but rotatively locked relative to the output shaft 16 by means of a ball spline 23, and torque transferring balls 24 located between the driving and driven clutch halves 20 and 22, respectively. The balls 24 are three in number and are spaced by equal angles relative to each other.

Figure 4:
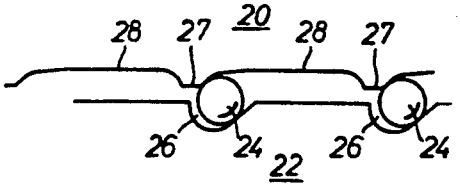
FIG. 4 shows a schematical illustration of the override clutch.

As illustrated in FIG. 4, the balls 24 are partly received in slanted pockets 26 in the driven clutch half 22 and engage cam teeth 27 on the driving clutch half 20. Between the cam teeth 27 on the driving clutch half 20 there are straight dwell portions 28 over which the balls 24 may travel without transferring any torque between the clutch halves after having overridden the cam teeth 27.

A compression spring 29 exerts an axial bias force on the driven clutch half 22 to make the balls 24 together with the cam teeth 27 and the slanted ball pockets 26 transfer a torque up to a desired magnitude.

A torque nonresponsive coupling 30 is formed between the rear end of the driving clutch half 20 and a drive spindle 31. This coupling 30 permits an axial push start movement of the output shaft 16 and the override clutch 15 when operating axially the tool housing 10. A push start movement counteracting spring 32 acts between the drive spindle 31 and the output shaft 16.

Associated with the override clutch 15 there is a power shut-off mechanism which includes a pressure air supply valve 34 cooperating with a valve seat 35 in the inlet passage 11 and a push rod 36 axially extending through the motor 13 to endwise engage a tappet 37. The latter is formed with a waist 38 which defines a forwardly facing shoulder 39. The tappet 37 extends through an opening 40 in a latch 41 which is movably supported in a transverse guide way 42 in the driven clutch half 22. The tappet 37 is arranged to be axially supported by the latch 41 by interengagement of the shoulder 39 and the edge of the opening 40. See FIG. 2.

In a coaxial bore 33 in the output shaft 16 there is located compression spring 43 which acts on the tappet 37 in order to accomplish a resetting bias force on the latter.

Figure 2:
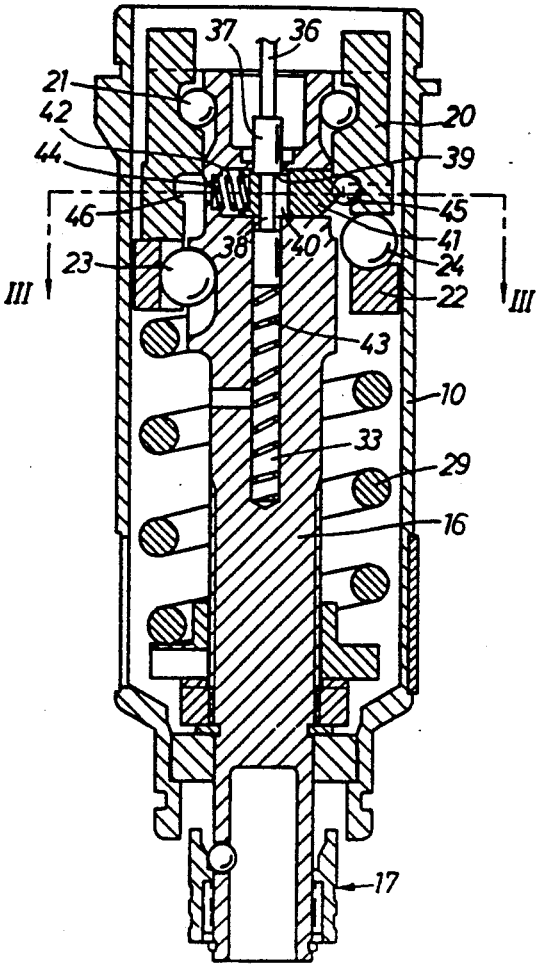
FIG. 2 shows, on a larger scale, a longitudinal section through the front part of the screw driver in FIG. 1.
Figure 3:
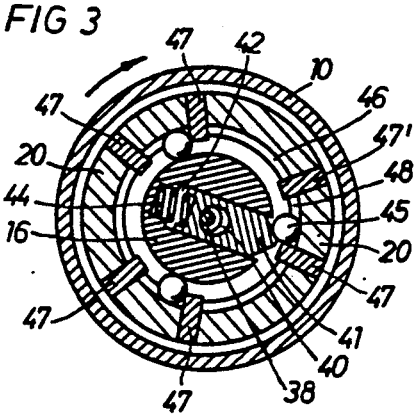
FIG. 3 shows a cross section along line III—III in FIG. 2.

A spring 44 is arranged to bias the latch 41 to the right in FIG. 2, thereby making the pointed right hand end of the latch 41 protrude from the output shaft 16. The latch 41 thereby engages either one of three balls 45 which are movably supported in a circumferential groove 46 in the driving clutch half 20. As best illustrated in FIG. 3, there are three pairs of radial pins 47 extending into the groove 46, each pair forming the circumferential limits of one pocket 48 supporting one of the balls 45. The size of the pockets 48 provide for a certain freedom of circumferential movement of the balls 45.

The diameter of the balls 45 is larger than the radial extent of the pins 47, and the latch 41 is arranged to engage the balls 45 only at relative rotation between the clutch halves.

As described above, the number of torque transferring balls 24 is three as is the number of actuating balls 45. The number of balls 24 and 45 is not critical per se, but it is important that the number of torque transferring balls 24 equals the number of actuating balls 45.

In operation, the screw driver is connected to a pressure air source, and the chuck 17 is fitted with a screw engaging bit. As the bit is put into engagement with a screw to be tightened and an axial push force is applied on the housing 10, the output shaft 16, the entire override clutch 15 and the push rod 36 are shifted backwards. This means that the valve 34 is lifted off the seat 35 and opens the pressure air suppy passage to the motor 13. Then, torque is delivered from the motor 13 to the drive spindle 31 and further via the coupling 30 to the override clutch 15 and the output shaft 16.

This operating position of the clutch 15 is shown in FIGS. 1, 2, and 4 and means that the push rod 36 rests endwise on the tappet 37 which in turn rests by its waist shoulder 39 on the latch 41. The latter is kept in its latching position by the spring 44. The operating and torque transferring position of the clutch 15 also means that the balls 24 are trapped between the slanted side surfaces of the pockets 26 and the inclined surfaces of the teeth 27 of the driving clutch half 20.

In this relative position of the clutch halves 20 and 22, the one of the balls 45, which is closest to the protruding end of the latch 41, is located at a distance from the particular one $47^1$ of the pins 47 which will form a stop for the ball 45 at relative rotation between the clutch halves 20, 22. This means that there has to be a certain amount of relative rotation between the clutch halves 20, 22 before the ball 45 is stopped against pin $47^1$ and an unlatching engagement is obtained between the latch 41 and the ball 45. The direction of rotation of the driving clutch half 20 is illustrated by an arrow in FIG. 3.

During the tightening process, the torque resistance from the screw joint increases, which means that the clutch balls 24 climb higher on the cam teeth 27 until the separating force on the clutch halves exceeds the pretension of the spring 28. This is the position where the set maximum torque is reached. Then the balls 24 pass over the top crests of the cam teeth 27 and the torque transfer ceases immediately. However, the driving clutch half 20 together with the drive spindle 31 and the motor 13 continue to rotate.

During the override movement of the clutch halves 20, 22, a relative rotation between the latch 41 and the ball stopping pins 47 takes place. During this movement, the latch 41 brings one of the balls 45 into engagement with one of the pins 47 such that a camming action occurs between the ball 45 and the latch 41. Then, the latter is shifted inwardly to thereby release the tappet 37 and the push rod 36 and accomplish a closing of the valve 34.

This takes place as soon as the clutch balls 24 have passed their maximum torque transferring position relative to the cam teeth 37. At continued relative rotation between the clutch halves, the balls 24 move past the straight dwell portions 28 of the driving clutch half 20 which means a complete release of the clutch 15. Since the latch 41 was shifted to its push rod 36 releasing and motor shut-off position immediately after the maximum torque position was passed, the dwell period of the clutch 15 enables the motor 13 and other post-release rotating parts to retard to stand still before the clutch 15 reengages and restarts transferring torque to the screw joint.

As the tightening process is completed and the motor 13 has been shut off, the tool is lifted off the screw joint. Thereby, the spring 32 returns the output shaft 16 and the clutch 15 to their forward positions. Now, the spring 43 ensures that the tappet 37 is moved upwards enabling the latch 41 to return to its inactivated position. The shut-off initiating mechanism is now reset and ready for another tightening operation.

The peripheral movability of the latch activating balls 45, i.e. the peripheral width of the pockets 48 formed by the pins 47, makes it possible to obtain a ball/latch engagement point which is accurately located in relation to the release point of the override clutch 15, not only at "forward" rotation of the tool but at "reverse" rotation as well. In the latter case, the ball 45 engaged by the latch 41 is trapped against the other of the two pins 47 of the pocket 48, whereby it is avoided that the latch 41 is activated and the motor is shut off before the maximum torque coupling is reached between the balls 24, the pockets 26 and the cam teeth 27 of the clutch 15.

The latch activating mechanism of the screw driver according to the invention is advantageous not only because of its ability to operate in both directions of rotation but also because of the very low mass of the self adjusting activating means, i.e. the balls 45, which provides for a safe adjustment of the mechanism to the correct latch activating point no matter how fast the torque growth in the screw joint being tightened.

I claim:

1. A screw joint tightening power tool, comprising:

a housing (10);

a rotation motor (13) and power control means (34) coupled to said motor (13);

power transmitting means coupling said motor (13) to an output shaft (16) said power transmitting means including a rolling member type override clutch (15) having a driving half (20) and a driven half (22), said clutch halves (20, 22) being coupled by torque transferring cam means (26, 27) which have trapped therebetween rolling members (24), and said clutch halves (20, 22) being provided with dwell portions (28) for allowing a limited relative rotation of said clutch halves (20, 22) without transferring any torque therebetween;

a control means shifting mechanism for controlling said power control means, said control means shifting mechanism being associated with said clutch (15) and including an axially extending and longitudinally displaceable rod (36) coupled to said power control means (34);

a latch member (41) radially movable relative to said output shaft (16) for movement between a rest position in which said rod (36) is axially supported in a power control means (34) ON-position and an activated position in which said rod (36) is released for axial movement towards a power control means (34) OFF-position; and actuating means (45) associated with the driving clutch half (20) for engaging and shifting radially said latch member (41) from said rest position to said activated position at relative rotation of said clutch halves (20, 22), said actuating means comprising a number of rolling elements (45) supported in pockets (48) in said driving clutch half (20), each of said pockets (48) having a peripheral extent so as to provide for peripheral movability of the corresponding roller element (45), thereby enabling self adjustment in both rotation directions of a point of actuating interengagement between said rolling elements (45) and said latch member (41) which corresponds to relative positions between said clutch halves (20, 22) where a maximum transferred torque of said clutch is just passed.

2. A power tool according to claim 1, wherein said pockets (48) are formed by a circumferential groove (46) in said driving clutch half (20) and a number of radial pins (47) extending into said groove (46) and arranged in pairs such that the pins (47) of each pair form the peripheral limits of one pocket (48).

3. A power tool according to claim 1, wherein the number of rolling elements (45) of said actuating means equals the number of rolling members (24) of said clutch (15).

4. A power tool according to claim 2, wherein the number of rolling elements (45) of said actuating means equals the number of rolling members (24) of said clutch (15).

* * * * *